US006527519B2

(12) United States Patent
Hwang et al.

(10) Patent No.: US 6,527,519 B2
(45) Date of Patent: Mar. 4, 2003

(54) APPARATUS AND METHOD FOR CONTROLLING THE OPERATION OF A LINEAR COMPRESSOR USING A SUCTION/DISCHARGE PRESSURE DIFFERENCE STORING UNIT

(75) Inventors: Yin Young Hwang, Anyang (KR); Joon Hyung Park, Seoul (KR); Jin Koo Park, Kwangmyung (KR); Yang Gyu Kim, Seoul (KR); Se Young Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/995,650

(22) Filed: Nov. 29, 2001

(65) Prior Publication Data

US 2002/0062652 A1 May 30, 2002

(30) Foreign Application Priority Data

Nov. 29, 2000 (KR) ..... 00-71662
Nov. 29, 2000 (KR) ..... 00-71663

(51) Int. Cl.[7] ..... F04B 49/06

(52) U.S. Cl. ..... 417/44.11; 417/53; 417/44.1; 417/45; 417/18; 417/212; 417/417

(58) Field of Search ..... 417/53, 44.1, 45, 417/18, 44.11, 212, 417

(56) References Cited

U.S. PATENT DOCUMENTS 4,783,807 A * 11/1988 Marley ..... 381/43
5,947,693 A * 9/1999 Yang ..... 417/45
5,980,211 A * 11/1999 Tojo et al. ..... 417/45
6,084,320 A * 7/2000 Morita et al. ..... 310/12
6,153,951 A * 11/2000 Morita et al. ..... 310/12
6,176,683 B1 * 1/2001 Yang ..... 417/44.1
6,231,310 B1 * 5/2001 Tojo et al. ..... 417/44.1
6,289,680 B1 * 9/2001 Oh et al. ..... 62/6

* cited by examiner

*Primary Examiner*—Charles G. Freay
*Assistant Examiner*—William H. Rodriguez
(74) *Attorney, Agent, or Firm*—Birch, Stewart, Kolasch & Birch, LLP

(57) ABSTRACT

In an apparatus and a method for controlling a linear compressor, an apparatus for controlling a linear compressor includes a linear compressor adjusting a refrigerating capacity by a stroke voltage according to a stroke reference value, a current detecting unit detecting a current applied to the linear compressor, a work operation unit generating a work operation signal by integrating a current detected from the current detecting unit, a suction/discharge pressure difference storing unit storing a suction/discharge pressure difference according to the work operation signal, a microcomputer outputting a switching control signal according to the work operation signal and displaying the suction/discharge pressure difference according to the work operation signal, and an electric circuit unit controlling the linear compressor in accordance with the switching control signal. Accordingly it is possible to detect accurately a load of a linear compressor and control a linear compressor precisely by detecting a suction/discharge pressure difference according to a work operation signal obtained by integrating a current value according to a stroke reference value in accordance with a switching control signal of the microcomputer.

20 Claims, 6 Drawing Sheets

APPARATUS AND METHOD FOR CONTROLLING THE OPERATION OF A LINEAR COMPRESSOR USING A SUCTION/DISCHARGE PRESSURE DIFFERENCE STORING UNIT

BACKGROUND OF THE INVENTION

1. Field of the Invention

The present invention relates to an apparatus and a method for controlling a linear compressor, and in particular to an apparatus and a method for controlling a linear compressor which are capable of controlling precisely movements of the linear compressor by detecting accurately a load occurred in the linear compressor and varying a stroke voltage applied to the linear compressor.

2. Description of the Prior Art

Generally, a linear compressor compresses a refrigerant by performing a reciprocation linear motion of a piston with a magnet and a coil instead of a crank shaft.

The linear compressor will be described in detail with reference to accompanying FIG. 1.

FIG. 1 is a block diagram illustrating a construction of an apparatus for controlling a linear compressor. The apparatus for controlling a linear compressor includes a voltage detecting unit 30 detecting a voltage applied to a linear compressor according to increase of a stroke in accordance with a stroke voltage, a current detecting unit 20 detecting a current outputted from the linear compressor 12 according to the increase of the stroke in accordance with the stroke voltage, a microcomputer 40 calculating a stroke from a voltage and a current detected from the voltage detecting unit 30 and the current detecting unit 20, comparing the stroke with a stroke reference value and outputting a switching control signal according to the comparison result, and an electric circuit unit 10 applying a stroke voltage to the linear compressor 12 according to the switching control signal of the microcomputer 40.

The electric circuit unit 10 includes a linear compressor 12 adjusting a refrigerating capacity by varying a stroke by adjusting a velocity of up and down motion of a piston, a triac Tr1 intermitting a voltage of AC power applied to the linear compressor, and a current sensing resistance R1.

In the linear compressor 12, because the piston moves up and down by a stroke voltage according to a stroke reference value set by a user, the stroke can be varied, and accordingly a refrigerating capacity can be adjusted.

The operation of the apparatus for controlling the linear compressor will be described.

First, when a user sets a request temperature, the microcomputer 40 inputs a switching control signal according to a stroke reference value set by a user to the triac Tr1 of the electric circuit unit 10.

The triac Tr1 of the electric circuit unit 10 controls a voltage applied to the linear compressor 12 according to the switching control signal, the piston of the linear compressor 12 performs an up and down motion, the stroke is varied according to the up and down motion of the piston of the linear compressor 12, accordingly the refrigerating capacity can be adjusted.

In more detail, when a turn-on cycle is enlarged according to the switching control signal inputted to the triac Tr1 of the electric circuit unit 10, the stroke voltage increases, accordingly the stroke is increased.

When the stroke is varied, a voltage and a current generated in the linear compressor 12 are respectively detected in the voltage detecting unit 30 and the current detecting unit 20 and inputted to the microcomputer 40.

The microcomputer 40 calculates the stroke by using the inputted voltage and current, the stroke is compared with the stroke reference value, a switching control signal according to the comparison result is outputted.

In more detail, when the calculated stroke is smaller than the stroke reference value, the microcomputer 40 outputs a switching control signal for enlarging the on cycle of the triac Tr1, accordingly the stroke voltage applied to the linear compressor 12 is increased. When the calculated stroke is larger than the stroke reference value, a switching control signal for shortening an on cycle of the triac Tr1 is outputted, accordingly a stroke voltage applied to the linear compressor is decreased.

Unlike the conventional compressor the linear compressor 12 performs a linear motion, because of the reason it does not require a crankshaft converting a rotation motion into a linear motion, accordingly the linear compressor 12 has a low resistance loss and high efficiency.

In addition, by varying the stroke voltage applied to the linear compressor, the linear compressor varies a compression ratio, accordingly the linear compressor can be used for variable refrigerating control such as a refrigerator or an air conditioner, etc.

In order to control the stroke of the linear compressor 12, the microcomputer 40 measures a load as basic information of the compressor, in order to measure the load, an outer temperature or a temperature of a condenser is used.

However, when the temperature is sensed through the sensor, because an accurate temperature can not be detected, it is impossible to detect a load accurately, and because a delay occurs in the temperature sensing, the linear compressor can not be controlled accurately.

SUMMARY OF THE INVENTION

It is an object of the present invention to provide an apparatus and a method for controlling a linear compressor which are capable of detecting accurately a load having a non-linearity characteristics and controlling a linear compressor so as to operate in a safe region by inducing suction/discharge pressure difference.

It is another object of the present invention to provide an apparatus and a method for controlling a linear compressor which are capable of detecting accurately a stroke of the linear compressor by inducing a suction/discharge pressure difference with a work operation value calculated by multiplying a current by a size of displacement and integrating the product.

In order to achieve the above-mentioned objects, an apparatus for controlling a linear compressor in accordance with the present invention includes a linear compressor adjusting a refrigerating capacity by a stroke voltage according to a stroke reference value, a current detecting unit detecting a current applied to the linear compressor, a work operation unit generating a work operation signal by integrating a current detected from the current detecting unit, a suction/discharge pressure difference storing unit storing a suction/discharge pressure difference according to the work operation signal, a microcomputer outputting a switching control signal according to the work operation signal and displaying the suction/discharge pressure difference according to the work operation signal, and an electric circuit unit controlling the linear compressor in accordance with the switching control signal.

In order to achieve the above-mentioned objects, a method for controlling a linear compressor in accordance with an embodiment of the present invention includes outputting a switching control signal according to the stroke reference value when a user inputs a request early stroke reference value, applying a stroke voltage applied to the linear compressor according to the switching control signal, detecting a current applied to the linear compressor when the linear compressor operates in accordance with the stroke voltage, generating a work operation signal by integrating the detected current, displaying the load by detecting a suction/discharge pressure difference according to the work operation signal, and varying a duty ratio of the switching control signal controlling the motion of the linear compressor by comparing the inputted work operation signal with a previous work operation signal.

In order to achieve the above-mentioned objects, a method for controlling a linear compressor in accordance with another embodiment of the present invention includes an outputting a switching control signal according to the stroke reference value when a user inputs a request early stroke reference value, outputting a switching control signal according to the stroke reference value, applying a stroke voltage applied to the linear compressor according to the switching control signal, detecting a current and a voltage applied to the linear compressor when the linear compressor is operated in accordance with the stroke voltage, calculating a displacement of the detected current and voltage, generating a work operation signal by the detected current and displacement, displaying a load by detecting a suction/discharge pressure difference according to the work operating signal, and varying a duty ratio of the switching control signal controlling the operation of the linear compressor by the work operation signal.

DETAILED DESCRIPTION OF THE PREFERRED EMBODIMENT

An apparatus and a method for controlling a linear compressor in accordance with embodiments of present invention will be described in detail.

Figure 1:
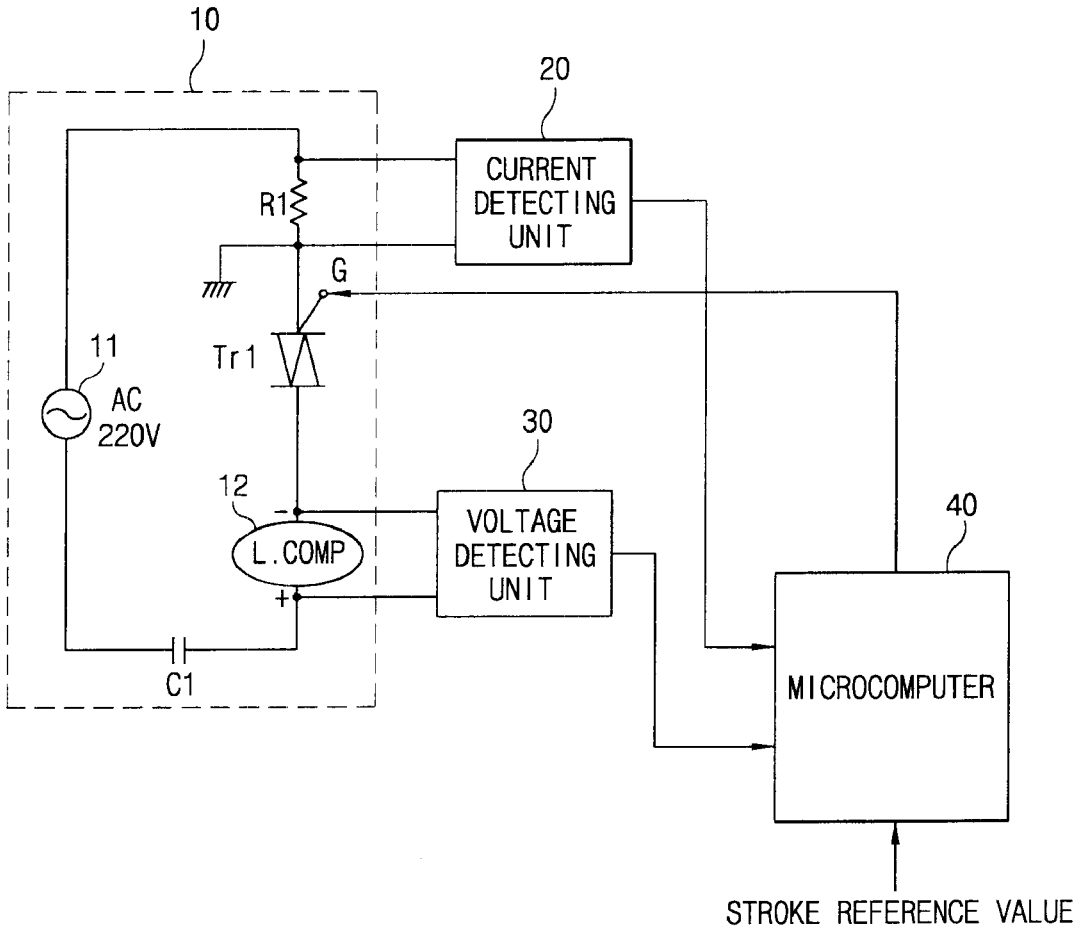
FIG.1 CONVENTIONAL ART
FIG. 1 is a block diagram illustrating a construction of an apparatus for controlling a linear compressor in accordance with the prior art.
Figure 2:
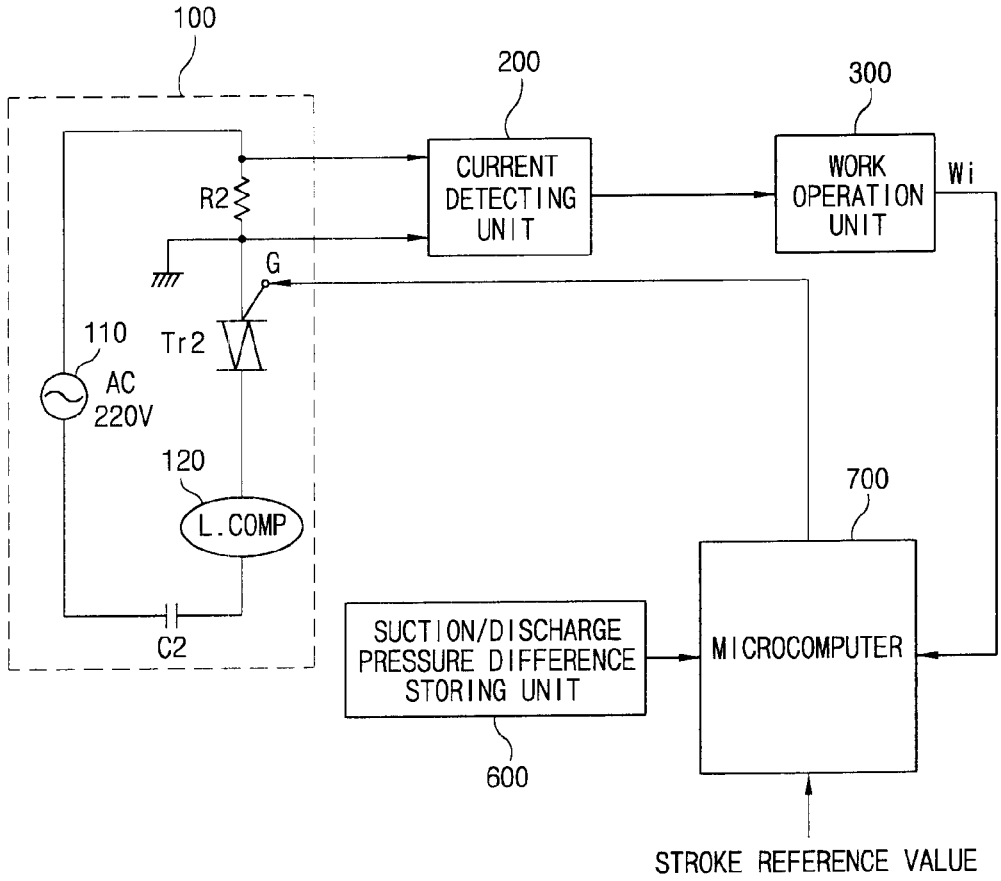
FIG. 2 is a block diagram illustrating a construction of an apparatus for controlling a linear compressor in accordance with an embodiment of the present invention.

FIG. 2 is a block diagram illustrating a construction of an apparatus for controlling a linear compressor in accordance with the present invention. The apparatus for controlling the linear compressor in accordance with the present invention includes a current detecting unit 200 detecting a current applied to the linear compressor 120 in accordance with variation of a stroke voltage, a work operation unit 300 integrating one cycle of the current detected from the current detecting unit 200 and outputting a work operation signal according to it, a suction/discharge pressure difference storing unit 600 pre-storing a suction/discharge pressure difference according to the work operation signal, a microcomputer 700 detecting a suction/discharge pressure difference according to the work operation signal outputted from the work operation unit 300 in the suction/discharge pressure storing unit 600, displaying it as a load, comparing the inputted work operation signal with a previous work operation signal and outputting a switching control signal controlling a stroke, and an electric circuit unit 100 being inputted the switching control signal from the microcomputer 700 and controlling the linear compressor 120.

The suction/discharge pressure difference storing unit 600 is included in the microcomputer 700.

The electric circuit unit 100 includes a linear compressor 120 adjusting a refrigerating capacity by varying a stroke with a up and down motion of a piston according to the stroke voltage in accordance with a switching control signal outputted from the microcomputer 700, a power voltage unit 110 applying AC power of 220V to the linear compressor 120, a triac Tr2 intermitting a voltage of the power voltage unit 120 applied to the linear compressor 120, and a current sensing resistance R2.

The operation of the apparatus for controlling the linear compressor will be described in detail with reference to accompanying FIG. 3.

Figure 3:
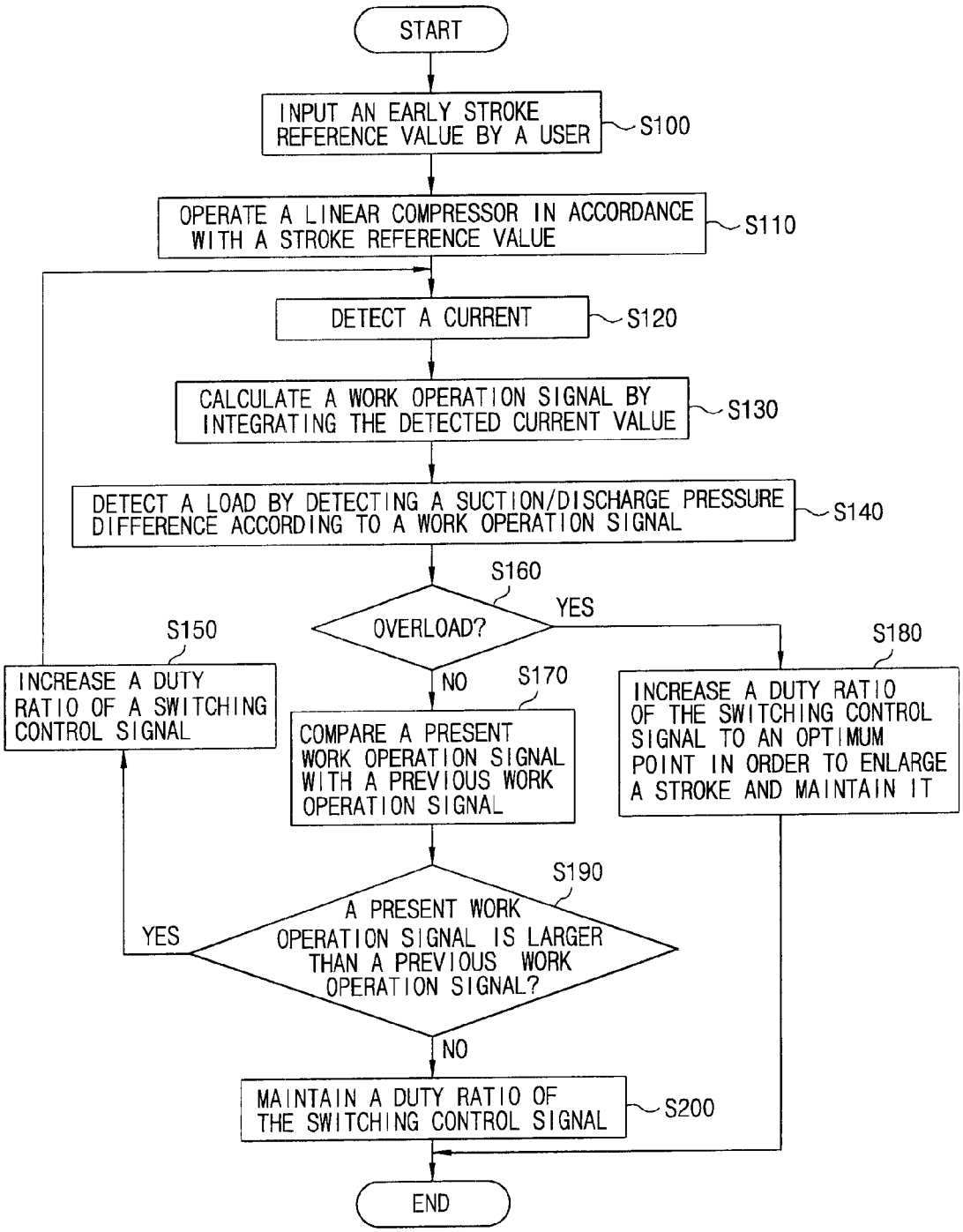
FIG. 3 is a flow chart illustrating a method for controlling a linear compressor in accordance with the present invention.

FIG. 3 is a flow chart illustrating a method for controlling a linear compressor in accordance with the present invention. When a user sets a request temperature at a refrigerator or an air conditioner, etc., a stroke reference value according to the temperature set by the user is inputted to the microcomputer 700 as shown at step S100.

The microcomputer 700 generates a switching control signal according to the inputted stroke reference value and outputs it to the triac T2 of the electric circuit unit 100.

The triac Tr2 is turned on for the turn-on cycle according to the inputted switching control signal and applies the voltage to the linear compressor 120. The velocity of the reciprocation motion and stroke distance of the piston of the linear compressor 120 are controlled according to the magnitude of the applied voltage as shown at step 110, accordingly a refrigerating capacity in accordance with the stroke set by the user can be generated.

When the linear compressor 120 operates, the current detecting unit 200 detects a current applied to the linear compressor 120 according to the stroke reference value as shown at step S120 and outputs it to the work operation unit 300.

The work operation unit 300 integrates one cycle (1/60 second) of the inputted current as shown at step S130 and outputs the generated work operation signal to the microcomputer 700.

The method for generating a work operation signal can be described as below equation.

$$Wi=\int |i| \quad (1)$$

(1/60 second unit in an integral region)

Wi as a work operation signal i as a current outputted from a linear compressor

The microcomputer 700 reads a suction/discharge pressure difference corresponded to the inputted work operation signal from the suction/discharge pressure difference storing unit 600 and displays it as a load as shown at step S140, accordingly the user can know the load of the present linear compressor 120.

The suction/discharge pressure difference stored in the suction/discharge pressure difference storing unit 600 is measured through experiments, the duty-ratio of the switching control signal outputted from the microcomputer 700 is varied while the suction/discharge pressure difference of the linear compressor 120 is maintained fixedly, the work operation signal as the integral value of the current according to the varied switching control signal, the suction/discharge pressure difference according to the measured work operation signal is measured, and the measured suction/discharge pressure difference is stored in the suction/discharge pressure difference storing unit 600.

When the load is detected by reading the suction/discharge pressure difference stored in the suction/discharge pressure difference storing unit 600 according to the work operation value integrating the current, because the suction/discharge pressure difference can be directly induced by detecting the present current value and the duty ratio of the switching control signal, a time required for detecting the load can be shortened and the load can be precisely detected, accordingly the linear compressor can be controlled accurately according to the load.

As the load is displayed, at the same time the microcomputer 700 compares the inputted work operation with a previous work operation signal as shown at step S170, and the electric circuit unit 100 outputs a switching control signal controlling the triac Tr2.

When the switching control signal is inputted to the triac Tr1, the triac Tr1 performs on/off operation according to the switching control signal, accordingly the stroke voltage inputted to the linear compressor 120 is controlled.

In more detail, the inputted work operation signal is compared with a previous work operation signal as shown at step S170, when the difference is not greater than a certain value, the duty ratio of the switching control signal is gradually increased and is outputted to the triac Tr2 as shown at step S150, the triac tr2 controls the turn on time by the inputted switching control signal and controls the stroke voltage applied to the linear compressor 120.

In addition, in the comparison with the inputted work operation signal with the previous work operation signal, when the difference is not less than a certain value as a TDC is 0, the microcomputer 700 maintains and outputs a switching control signal having a preset duty ratio as shown at step S200, the triac Tr1 being inputted the switching control signal maintains the stroke voltage inputted to the linear compressor 202, accordingly a velocity and a stroke distance of the piston of the linear compressor 120 are maintained.

The operation of the above-mentioned linear compressor will be described with reference to accompanying FIG. 4.

Figure 4:
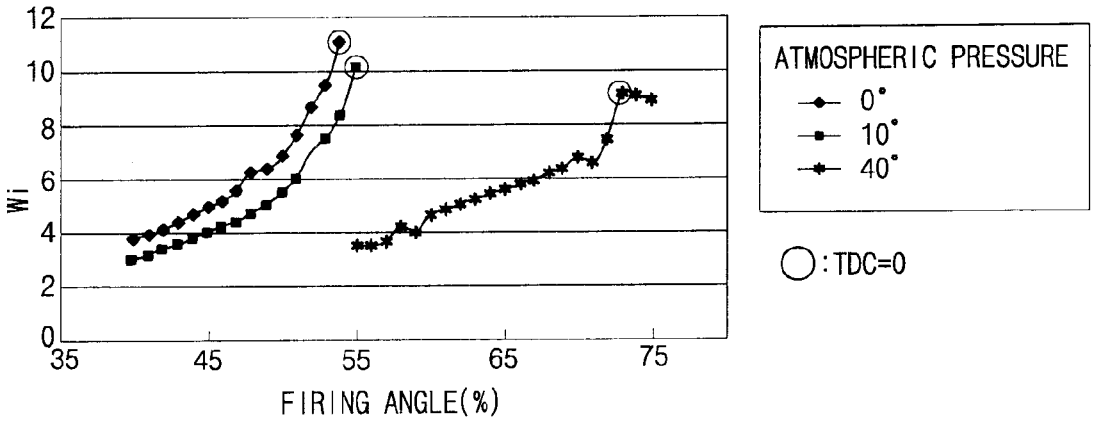
FIG. 4 is a graph illustrating variation of a work operation signal according to the duty ratio of the switching control signal in FIG. 2.

FIG. 4 is a graph illustrating variation of a work operation signal according to the duty ratio of the switching control signal in FIG. 2. As the pressure of the suction and the discharge of the linear compressor are maintained fixedly, it illustrates the variation of the size of the work operation signal as an integral value of the current according to the variation of the duty ratio of the switching control signal controlling power applied to the linear compressor, there is a point in which a difference between the present work operation signal and the previous work operation signal increases sharply, in the result of the experiment it is a point as the TDC is '0'.

When the TDC is '0', because the linear compressor has a maximum efficiency and compressive force, the stroke distance and the velocity of the piston can be maintained.

However, when the load of the linear compressor 120 is large, the top according to the load as the TDC is 0 deviates from a death line of the stroke distance in which the piston of the linear compressor moves right/left, herein the microcomputer 700 maintains the switching control signal in the range within the death line although the TDC is not '0' when the duty ratio of the switching control signal is increased and reaches to the top.

In the above-mentioned operation, although the overload occurs, the linear compressor can be operated in the safe region without being damaged.

As described above, the load is detected by reading the suction/discharge pressure difference stored in the suction/discharge pressure difference storing unit 600 according to the work operation value integrating the current, a time for detecting the load is shortened, a precise control according to the load can be performed, although the load is not less than a certain value, a value controlling the stroke distance of the refrigerator is controlled as a maximum value, accordingly the linear compressor can be operated in the safe region.

As described above, the linear compressor 120 can be controlled by detecting the load of the linear compressor, and it is possible also to control the linear compressor by calculating a work value of the linear compressor 120.

It will now be described in more detail with reference to accompanying FIG. 5.

Figure 5:
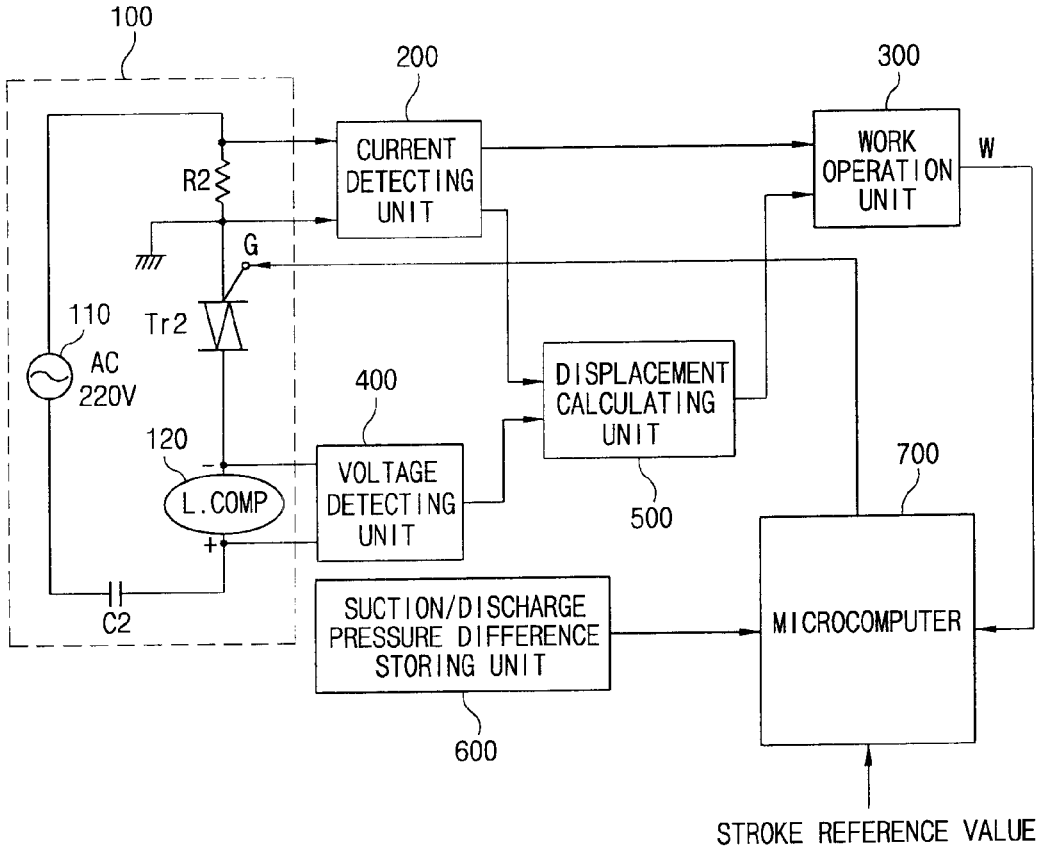
FIG. 5 is a block diagram illustrating a construction of an apparatus for controlling a linear compressor in accordance with another embodiment of the present invention.

FIG. 5 is a block diagram illustrating a construction of an apparatus for controlling a linear compressor in accordance with another embodiment of the present invention. The apparatus for controlling the linear compressor in accordance with another embodiment of the present invention includes a current detecting unit 200, a voltage detecting unit 500 detecting a voltage of the linear compressor according to the variation of the stroke in accordance with a stroke voltage, a displacement calculating unit 400 calculating a displacement of the current and the voltage respectively detected from the current detecting unit 200 and the voltage detecting unit 500, a work operation unit 300 outputting a work operation signal by multiplying the displacement outputted from the displacement calculating unit 400 and the current outputted form the current detecting unit 200 together, a suction/discharge pressure difference storing unit 600 respectively storing a suction/discharge pressure difference according to a plurality of work operation signals, a microcomputer 700 reading the suction/discharge pressure difference in accordance with the work operation signal from the suction/discharge pressure difference storing unit 600, displaying it as a load, calculating the sum of the area of the signal varied according to the current and displacement detected form the linear compressor 120, comparing the work operation signal of the work operation unit 300 with a previous work operation signal and outputting a switching control signal in accordance with the comparison result, and an electric circuit unit 100 intermitting AC (alternating current) power according to the switching control signal outputted from the microcomputer and applying a stroke voltage to the linear compressor 120.

Because the construction and operation of the current detecting unit 200 and the electric circuit unit 100 are same with the construction and operation in the embodiment of the present invention, explanation about the current detecting unit 200 and the electric circuit unit 100 will be abridged.

The operation of the apparatus for controlling the linear compressor in accordance with another embodiment of the present invention will be described.

First, when a certain value is inputted by a user, a stroke reference value according to the input value is inputted to the microcomputer 700. The microcomputer 700 outputs a switching control signal according to the stroke reference value to the triac Tr1 of the electric circuit unit 100.

A turn on cycle of the triac Tr1 is controlled according to the inputted switching control signal, the stroke voltage inputted to the linear compressor 120 is varied, accordingly the linear compressor 120 operates.

When the linear compressor 120 operates, the voltage detecting unit 500 detects a voltage applied to the linear compressor according to the stroke variation, at the same time the current detecting unit 200 detects the current flowing on the linear compressor 120 according to the stroke variation and inputs it to the displacement calculating unit 400.

The displacement calculating unit 400 calculates a displacement by using the inputted voltage and current and outputs it to the work operation unit 300. The work operation unit 300 multiplies the displacement value inputted from the displacement calculating unit 400 and the current inputted from the current detecting unit 200 together, integrates the product and outputs it as a work operation signal.

It can be described as below equation (2)

$$W=\int |i|\times|s| \quad (2)$$

1/60 second unit in an integral region

Wi as a work operation signal i as a current outputted from the linear compressor s as a displacement value of a voltage and a current detected from the linear compressor.

The work operation unit 300 outputs the computed work operation signal to the microcomputer 700.

The microcomputer 700 detects a value corresponded to a suction/discharge pressure difference according to the inputted work operation signal in values stored in the suction/discharge pressure difference storing unit 600 and displays it.

By the displayed suction/discharge pressure difference, the user can know the load generated in the linear compressor 120.

The suction/discharge pressure difference stored in the suction/discharge pressure difference storing unit 600 is a value set through experiments, it is set by measuring and storing a variation value of a work operation signal generated in accordance with a duty ratio of a switching control signal controlling the power applied to the linear compressor 120 while the suction and discharge pressure generated from the linear compressor 120 are maintained fixedly. By measuring the work operation signal in the operation of the linear compressor, it is possible to know a load applied to the linear compressor 120, accordingly the linear compressor 120 can be controlled precisely.

In addition, the microcomputer 700 compares a present work operation signal inputted from the work operation unit 300 with a previous work operation signal, when the difference is not greater than a certain value, the duty ratio of the switching control signal is gradually increased and outputted, when the difference between the present work operation signal the previous work operation signal is not less than a certain value, a switching control signal having a duty ratio at a present point is maintained and outputted.

In addition, the microcomputer 700 calculates an area of a trace varied by being corresponded to a current and a trace generated in the operation of the linear compressor 120, calculates a stroke applied to the linear compressor 120, recognizes a work operation signal according to the increase of duty ratio of the switching control signal applied to the triac Tr2 of the electric circuit unit 100, induces a pre-stored suction/discharge pressure difference by the work operation signal, and provides it as load information for the precise control of the linear compressor 120.

When the switching control signal of the microcomputer 700 is inputted to the triac Tr1 of the electric circuit unit 100, the triac tr1 is turned on for the time according to the switching control signal, the stroke voltage is applied to the linear compressor 120, accordingly the operation of the linear compressor 120 is controlled.

Figure 6:
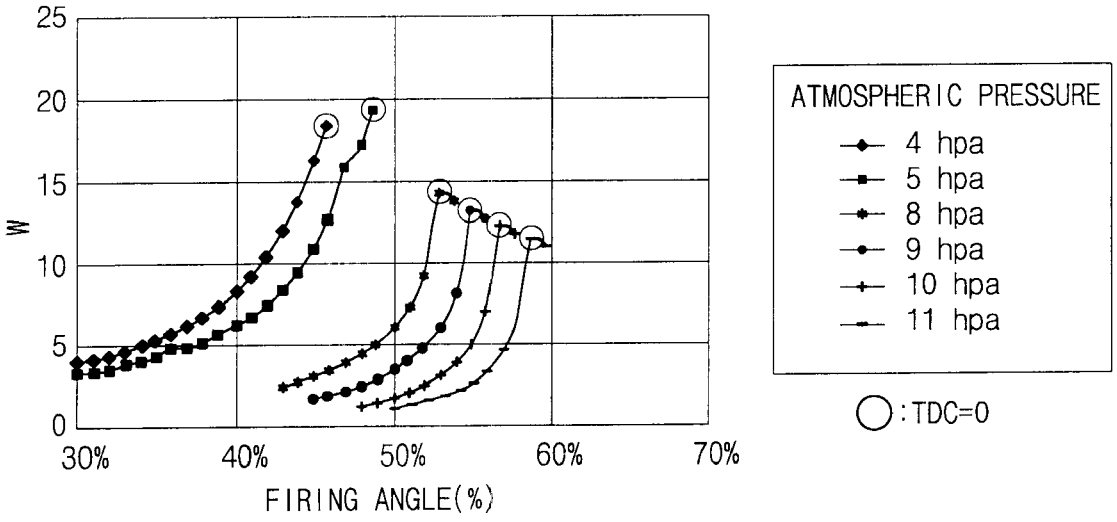
FIG. 6 is a graph illustrating variation of a work operation signal according to the increase of duty ratio of a switching control signal in FIG. 5.

FIG. 6 is a graph illustrating variation of a work operation signal according to the duty ratio increase of a switching control signal in FIG. 5. It illustrates a work operation signal according to the variation of the duty ratio of the switching control signal controlling the power applied to the linear compressor 120 while the pressure between the suction and the discharge of the linear compressor 120 is maintained fixedly, there is a point in which the difference between the present work operation signal and the previous work operation signal increases abruptly so as to be not less than a certain value, in the result of experiments the TDC as 0 is the point.

The efficiency of the linear compressor 120 is high to the utmost in the TDC as 0, when the TDC is 0, the microcomputer 700 maintains the stroke distance and the velocity of the linear compressor 120 as it is by maintaining the switching control signal.

As described above, by calculating a work operation value by detecting and integrating the current inputted to the linear compressor, the load occurred in the linear compressor can be detected accurately and rapidly, the apparatus for controlling the linear compressor in accordance with the present invention is possible to control the compressor precisely and perform a function of a safety device so as to operate the linear compressor in the safe region in sensing of overload.

In addition, by detecting a work value of the linear compressor precisely by calculating an area of a signal varied by a displacement according to the current applied to the linear compressor, the apparatus for controlling the linear compressor in accordance with the present invention is possible to control the linear compressor precisely and improve a compressor efficiency by controlling the linear compressor so as to be operated at an optimum velocity.

What is claimed is:

1. An apparatus for controlling a linear compressor, comprising:

a linear compressor adjusting a refrigerating capacity by a stroke voltage according to a stroke reference value;

a current detecting unit detecting a current applied to the linear compressor;

a work operation unit generating a work operation signal by integrating a current detected from the current detecting unit;

a suction/discharge pressure difference storing unit storing a suction/discharge pressure difference according to the work operation signal;

a microcomputer outputting a switching control signal according to the work operation signal and displaying the suction/discharge pressure difference according to the work operation signal; and an electric circuit unit controlling the linear compressor in accordance with the switching control signal.

2. The apparatus of claim 1, wherein the work operation unit generates a work operation signal by integrating one cycle of a current outputted from the current detecting unit.

3. The apparatus of claim 1, wherein the electric circuit unit includes:

a switching unit adjusting a stroke voltage according to a switching control signal outputted from the microcomputer;

a linear compressor adjusting a refrigerating capacity according to a stroke voltage outputted from the switching unit;

a power voltage unit applying AC power of 220V; and a current sensing resistance sensing a current outputted from the linear compressor.

4. The apparatus of claim 1, wherein the microcomputer includes a memory orderly storing a work operation signal of the work operation unit.

5. The apparatus of claim 1, wherein the microcomputer includes the suction/discharge pressure difference storing unit.

6. The apparatus of claim 1, wherein the microcomputer compares a present work operation signal with a previous work operation signal, when the difference between the present work operation signal the previous work operation signal is less than a certain value, the duty ratio of the switching control signal is gradually increased and outputted, when the difference is more than a certain value, a switching control signal at a present time point is maintained and outputted in order to maintain a stroke voltage fixedly.

7. The apparatus of claim 1, wherein the suction/discharge pressure difference storing unit measures and pre-stores a work operation signal generated according to the variation of the duty ratio of the switching control signal outputted from the microcomputer and a suction/discharge pressure difference according to the work operation signal while maintaining fixedly the suction/discharge pressure difference of the linear compressor.

8. The apparatus of claim 1, wherein the microcomputer reads the suction/discharge pressure difference according to the work operation signal from the suction/discharge pressure difference storing unit and displays it as a load.

9. The apparatus of claim 1, further comprising:

a voltage detecting unit detecting a voltage applied to the linear compressor in accordance with a switching control signal of the microcomputer; and a displacement calculating unit calculating a displacement of the voltage detected from the voltage detecting unit and the current detected from the current detecting unit.

10. The apparatus of claim 9, wherein the microcomputer calculates a work value of the linear compressor by calculating the sum of an area of a signal varied by being corresponded to a current outputted from the current detecting unit and a displacement outputted from the displacement calculating unit.

11. The apparatus of claim 1, wherein the work operation unit generates a work operation signal by multiplying the displacement calculated in the displacement calculating unit and the current detected from the current detecting unit together and integrating the product.

12. An apparatus for controlling a linear compressor, comprising:

a linear compressor adjusting a refrigerating capacity according to a stroke voltage in accordance with a stroke reference value;

a current detecting unit detecting a current applied to the linear compressor in accordance with the variation of the stroke by the stroke voltage;

a voltage detecting unit detecting a voltage applied to the linear compressor in accordance with the variation of the stroke by the stroke voltage;

a displacement calculating unit calculating a displacement of a current detected from the current detecting unit and a voltage detected from the voltage detecting unit;

a work operation unit generating a work operation signal by the current detected from the current detecting unit and the displacement calculated from the displacement calculating unit;

a suction/discharge pressure difference storing unit storing a suction/discharge pressure difference in accordance with the work operation signal;

a microcomputer calculating a stroke by outputting a switching control signal according to the work operation signal, displaying a suction/discharge pressure difference according to the work operation signal and calculating a sum of an area of a signal varied by being corresponded to the current and the displacement detected from the linear compressor; and an electric circuit unit controlling the stroke voltage applied to the linear compressor by intermitting AC power applied to the linear compressor in accordance with the switching control signal outputted from the microcomputer.

13. The apparatus of claim 12, wherein the work operation unit generates a work operation signal by multiplying the displacement inputted from the displacement calculating unit and the current inputted from the current detecting unit together and integrating the product.

14. A method for controlling a linear compressor, comprising:

outputting a switching control signal according to a stroke reference value when a user inputs a request early stroke reference value;

applying a stroke voltage to the linear compressor according to the switching control signal;

detecting a current applied to the linear compressor when the linear compressor operates in accordance with the stroke voltage;

generating a work operation signal by integrating the detected current;

displaying a load by detecting a suction/discharge pressure difference according to the work operation signal; and varying a duty ratio of the switching control signal controlling the motion of the linear compressor by comparing the inputted work operation signal with a previous work operation signal.

15. The method of claim 14, wherein the suction/discharge pressure difference is in proportion to a load of the linear compressor.

16. The method of claim 14, wherein the duty ratio of the switching control signal is increased when the inputted work operation signal is compared with a previous work operation signal and a difference between them is not greater than a certain value or the duty ratio of the switching control signal is maintained when the inputted work operation signal is compared with a previous work operation signal and a difference between them is not less than a certain value in the duty ratio varying step.

17. The method of claim 14, wherein the duty ratio of the switching control signal controlling the linear compressor is increased when an overload occurs in the linear compressor, and the duty ratio of the switching control signal is maintained when the piston of the linear compressor reaches to a highest operatable point in the duty ratio varying step.

18. A method for controlling a linear compressor, comprising:

outputting a switching control signal according to a stroke reference value when a user inputs a request early stroke reference value;

applying a stroke voltage to the linear compressor according to the switching control signal;

detecting a current and a voltage applied to the linear compressor when the linear compressor operates in accordance with the stroke voltage;

calculating a displacement of the detected current and voltage;

generating a work operation signal by the detected current and displacement;

displaying a load by detecting a suction/discharge pressure difference according to the work operation signal; and varying a duty ratio of the switching control signal controlling the motion of the linear compressor by the work operation signal.

19. The method of claim 18, wherein the work operation signal is generated by multiplying the detected current and displacement together and integrating the product.

20. The method of claim 18, wherein the stroke of the linear compressor is obtained by calculating a work value of the linear compressor by calculating a sum of an area of a trace varied by being corresponded to the current and the displacement in accordance with the duty ratio of the switching control signal.

* * * * *